US008066537B1

(12) United States Patent
Lin

(10) Patent No.: US 8,066,537 B1
(45) Date of Patent: Nov. 29, 2011

(54) PROBE CONNECTOR

(75) Inventor: Jui-Pin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 13/018,137

(22) Filed: Jan. 31, 2011

(51) Int. Cl.
*H01R 13/24* (2006.01)

(52) U.S. Cl. ..... 439/824; 439/877

(58) Field of Classification Search ..... 439/482, 439/700, 775, 824, 877
See application file for complete search history.

(56) References Cited

U.S. PATENT DOCUMENTS 5,348,497 A * 9/1994 Nitescu ..... 439/824
5,417,595 A * 5/1995 Cullen et al. ..... 439/700
7,708,607 B2 * 5/2010 Kuo et al. ..... 439/824
7,914,348 B1 * 3/2011 Lin ..... 439/700
* cited by examiner

*Primary Examiner* — Khiem Nguyen
(74) *Attorney, Agent, or Firm* — Cheng-Ju Chiang

(57) ABSTRACT

A probe connector adapted for fastening a cable thereto includes a shell, a plunger and an elastic element. The shell has a barrel and a base shell with an accommodating chamber therein. The base shell is connected with the barrel. A bottom of the base shell extends downward to form a connecting piece of which two opposite side edges oppositely extend outward to form two clipping pieces. The clipping pieces are bent towards each other to clip a core wire of the cable therebetween. The plunger is movably inserted in the barrel and further projects out of the barrel. The elastic element is telescopically assembled in the barrel and the accommodating chamber along the movement direction of the plunger, with one end thereof resisting against a bottom of the plunger and the other end thereof abutting against an inner side of a bottom plate of the base shell.

5 Claims, 2 Drawing Sheets

PROBE CONNECTOR

BACKGROUND OF THE INVENTION

1. Field of the Invention

The present invention relates to a probe connector, and more particularly to a probe connector capable of fastening a cable thereto tightly.

2. The Related Art

A traditional probe connector generally includes a barrel, a plunger and an elastic element. The elastic element is received in the barrel. One end of the plunger connected with the elastic element is movably restrained in the barrel. The other end of the plunger projects out of the barrel to connect with a mated connector. When the probe connector is mounted to a printed circuit board, an adsorbing machine is used for assisting the probe connector to be soldered on the printed circuit board.

However, the barrel of the traditional probe connector is difficult to be connected with a cable. So, if the probe connector needs to be connected with the cable, a new die for manufacturing a fastening portion is specially needed. Then one end of the fastening portion can be soldered to the barrel of the probe connector, and the other end of the fastening portion can be connected with the cable. The probe connector described above needs two dies for manufacturing the barrel and the fastening portion respectively. As a result, manufacturing cost and time are wasted accordingly.

SUMMARY OF THE INVENTION

An object of the present invention is to provide a probe connector adapted for fastening a cable thereto. The probe connector includes a shell, a plunger and an elastic element. The shell has a barrel and a box-shaped base shell with an accommodating chamber therein. The base shell is connected with the barrel with a bottom end of the barrel facing the accommodating chamber of the base shell. A bottom of the base shell extends downward to form a connecting piece of which two opposite side edges oppositely extend outward to form a pair of clipping pieces. The clipping pieces are capable of being bent towards each other to clip a core wire of one end of the cable therebetween for realizing an electrical connection between the cable and the probe connector. The plunger is movably inserted in the barrel and further projects out of a top end of the barrel. The elastic element is telescopically assembled in the barrel and the accommodating chamber of the base shell along the movement direction of the plunger, with one end thereof resisting against a bottom of the plunger and the other end thereof abutting against an inner side of a bottom plate of the base shell.

As described above, when the cable makes an electrical connection with the probe connector, the clipping pieces clip the one end of the core wire of the cable therebetween so as to make the cable secured to the probe connector tightly. Furthermore, the shell is just manufactured by a die, no new die is specially needed. As a result, manufacturing cost and time of the probe connector can be lowered accordingly.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
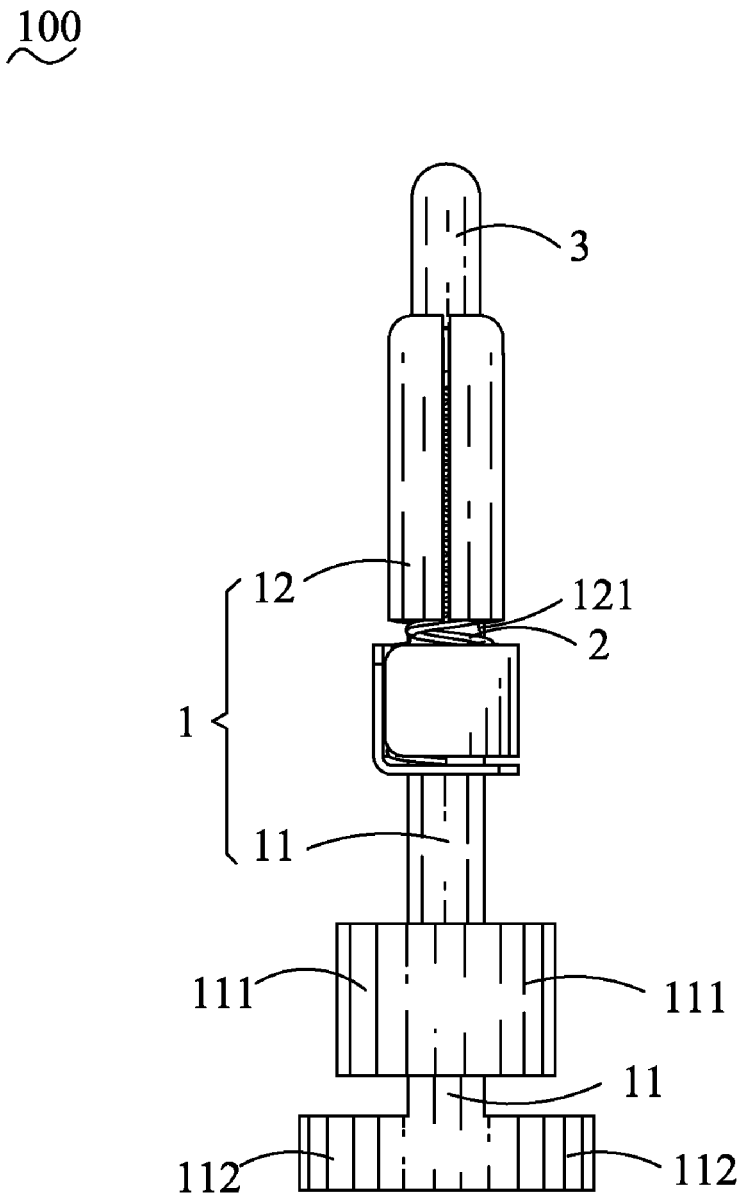
FIG. 1 is a perspective view of a probe connector according to the present invention.

With reference to FIG. 1, a probe connector 100 according to the present invention includes a shell 1, an elastic element 2 and a plunger 3 with a top end shaped as a dome.

Figure 2:
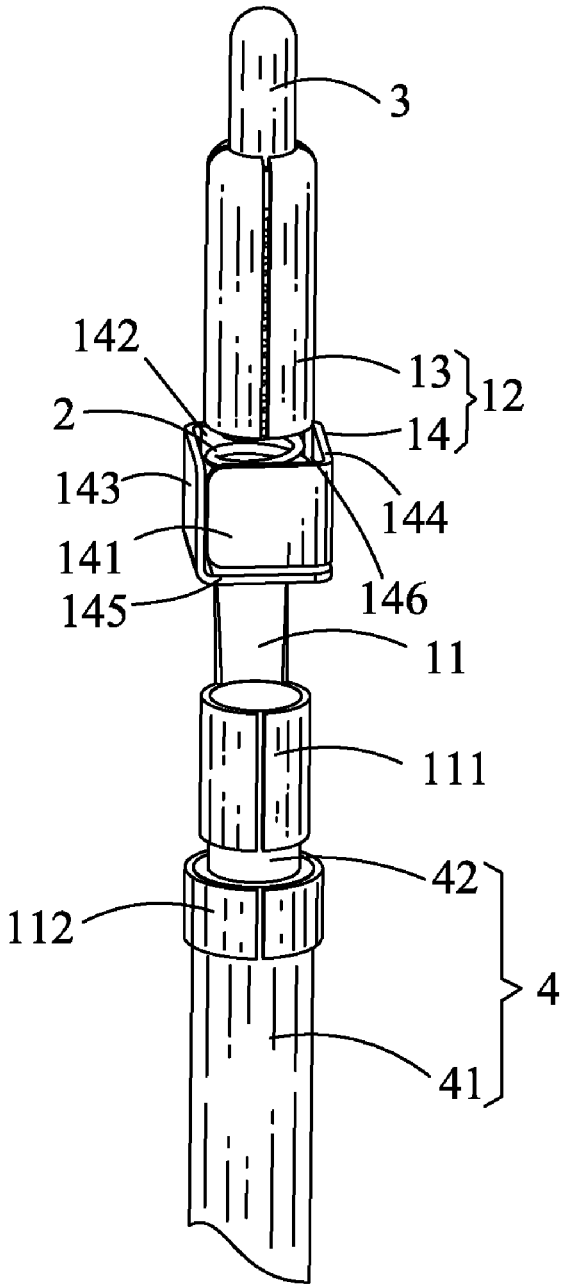
FIG. 2 is an assembled perspective view showing that a cable is fastened to the probe connector of FIG. 1.

Referring to FIGS. 1-2, the shell 1 is made of metal material, and includes a receiving shell 12 and a connecting piece 11 connected with the receiving shell 12. The receiving shell 12 includes a hollow barrel 13 looped from a metal plate and having a top end and a bottom end opened freely, and a base shell 14 connecting with the barrel 13. The base shell 14 is curved from an L-shaped metal plate to form a rectangular box-shape, with a front plate 141, a rear plate 142, a first side plate 143, a second side plate 144 and a bottom plate 145 defining a rectangular accommodating chamber 146 thereamong. A middle of a bottom edge of the barrel 13 and a middle of a top edge of the rear plate 142 are connected by an inclined piece 121 to make the barrel 13 located over the base shell 14 properly with the bottom end of the barrel 13 facing the accommodating chamber 146. A middle of a bottom edge of the rear plate 142 extends downward to form the connecting piece 11 of long strip shape. Two opposite side edges of a lower portion of the connecting piece 11 oppositely extend outward to form a pair of clipping pieces 111 apart from the bottom plate 145 and a bottom end of the connecting piece 11. Two opposite side edges of the bottom end of the connecting piece 11 also oppositely extend outward to form a pair of fastening pieces 112 wider than the corresponding clipping pieces 111.

Referring to FIGS. 1-2, the plunger 3 is movably inserted in the barrel 13 with the top end thereof further projecting out of the top end of the barrel 13 to connect with a mated connector, and a bottom end thereof movably restrained in the barrel 13. The elastic element 2 is partly inserted in the barrel 13 along the movement direction of the plunger 3 with a top end thereof resisting against a bottom of the plunger 3, and a bottom end thereof projecting out of the bottom end of the barrel 13. Then the first side plate 143, the second side plate 144, the front plate 141 and the bottom plate 145 are respectively bent relatively to the rear plate 142 to form the rectangular box-shaped base shell 14 for receiving the bottom end of the elastic element 2 in the accommodating chamber 146. The bottom end of the elastic element 2 further abuts against an inner side of the bottom plate 145 of the base shell 14.

Referring to FIGS. 1-2 again, a cable 4 is secured to the probe connector 100, and includes a dielectric layer 41 and a core wire 42 surrounded by the dielectric layer 41 except one end thereof. When the cable 4 is assembled to the probe connector 100, the one end of the core wire 42 without being surrounded by the dielectric layer 41 is disposed on the lower portion of the connecting piece 11 between the pair of clipping pieces 111, with the dielectric layer 41 adjacent to the one end of the core wire 42 being against the bottom end of the connecting piece 11 between the pair of fastening pieces 112. Then the clipping pieces 111 are arched towards each other to show a ring shape for tightly clipping the one end of the core wire 42 therebetween, and the fastening pieces 112 are also arched towards each other to show a ring shape for tightly clipping the dielectric layer 41 together with the core wire 42 therebetween. Consequently, the cable 4 can be secured to the probe connector 100 tightly and a good electrical connection between the cable 4 and the probe connector 100 is realized accordingly.

As described above, when the cable 4 makes an electrical connection with the probe connector 100, the clipping pieces 111 clip the one end of the core wire 42 therebetween and the fastening pieces 112 clip the dielectric layer 41 together with the core wire 42 therebetween so as to make the cable 4 secured to the probe connector 100 tightly. Furthermore, the shell 1 having the receiving shell 12, the connecting piece 11, the clipping pieces 111 and the fastening pieces 112 is just manufactured by a die, and no new die is specially needed. As a result, manufacturing cost and time of the probe connector 100 can be lowered accordingly.

What is claimed is:

1. A probe connector adapted for fastening a cable thereto, comprising:

a shell having a barrel and a box-shaped base shell with an accommodating chamber therein, the base shell connecting with the barrel with a bottom end of the barrel facing the accommodating chamber of the base shell, a bottom of the base shell extending downward to form a connecting piece of which two opposite side edges oppositely extend outward to form a pair of clipping pieces, wherein the clipping pieces are capable of being bent towards each other to clip a core wire of one end of the cable therebetween for realizing an electrical connection between the cable and the probe connector;

a plunger movably inserted in the barrel and further projecting out of a top end of the barrel; and an elastic element telescopically assembled in the barrel and the accommodating chamber of the base shell along the movement direction of the plunger, with one end thereof resisting against a bottom of the plunger and the other end thereof abutting against an inner side of a bottom plate of the base shell.

2. The probe connector as claimed in claim 1, wherein the clipping pieces are arched towards each other to together form a ring shape for securing the core wire of the one end of the cable therebetween.

3. The probe connector as claimed in claim 1, wherein the clipping pieces are formed apart from a bottom end of the connecting piece, two opposite edges of the bottom end of the connecting piece oppositely extend outward beyond the corresponding clipping pieces to form a pair of fastening pieces which are capable of being arched towards each other to together form a ring shape for fastening the one end of the cable therebetween.

4. The probe connector as claimed in claim 1, wherein the base shell is curved from an L-shaped metal plate to form the box-shape, with a front plate, a rear plate, a first side plate, a second side plate and the bottom plate defining the accommodating chamber thereamong.

5. The probe connector as claimed in claim 4, wherein a bottom edge of the barrel and a top edge of the rear plate of the base shell are connected by an inclined piece to make the barrel located over the accommodating chamber of the base shell, the connecting piece extends downward from a bottom edge of the rear plate of the base shell.

* * * * *